US006604031B2

(12) United States Patent
Oguma et al.

(10) Patent No.: US 6,604,031 B2
(45) **Date of Patent: *Aug. 5, 2003**

(54) TRAIN DETECTION SYSTEM AND A TRAIN DETECTION METHOD

(75) Inventors: Kenji Oguma, Hitachi (JP); Atsushi Kawabata, Hitachi (JP); Korefumi Tashiro, Hitachi (JP); Michio Fujiwara, Hitachinaka (JP); Shinya Tanifuji, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/219,269

(22) Filed: Aug. 16, 2002

(65) Prior Publication Data

US 2002/0193917 A1 Dec. 19, 2002

Related U.S. Application Data

(63) Continuation of application No. 09/986,089, filed on Nov. 7, 2002, now Pat. No. 6,470,244, which is a continuation of application No. 09/832,043, filed on Apr. 11, 2001, now Pat. No. 6,317,664, which is a continuation of application No. 09/073,851, filed on May 7, 1998, now Pat. No. 6,230,085.

(30) Foreign Application Priority Data

May 15, 1997 (JP) ..... 9-125261

(51) Int. Cl.[7] ..... B61L 1/18; B61L 3/08

(52) U.S. Cl. ..... 701/19; 246/28 R

(58) Field of Search ..... 701/19, 117; 340/993; 246/27, 28 R, 41, 28 F, 122 R

(56) References Cited

U.S. PATENT DOCUMENTS

| | | | |
|---|---|---|---|
| 3,868,075 | A | 2/1975 | Blazek et al. |
| 4,320,881 | A | 3/1982 | Campbell |
| 4,498,650 | A | 2/1985 | Smith et al. |
| 4,619,425 | A | 10/1986 | Nagel |
| 4,855,737 | A | 8/1989 | Poole |
| 5,459,663 | A | 10/1995 | Franke |
| 6,230,086 | B1 | 5/2001 | Oguma et al. |

FOREIGN PATENT DOCUMENTS

| | | |
|---|---|---|
| EP | 0 165 048 A2 | 12/1985 |
| EP | 0 410 218 A2 | 1/1997 |
| JP | 3-128760 | 5/1991 |
| JP | 9-193800 | 7/1997 |
| WO | WO 98/10618 | 3/1998 |

OTHER PUBLICATIONS

Collins et al.; Performance of Railway Track Circuit Codes with Burst Interference; IEEE; Vehicular Technology Conference, May 4–7, 1997; vol. 3; pp. 1927–1931.

*Primary Examiner*—Michael J. Zanelli
(74) *Attorney, Agent, or Firm*—Antonelli, Terry, Stout & Kraus, LLP

(57) ABSTRACT

A train detection system, having a transmitter which transmits a train detecting signal, a receiver, and a wayside controller connected to the transmitter and the receiver. The transmitter adds a first unique code assigned to the transmitter to the train detecting signal received from the wayside controller and transmits the thus processed train detecting signal and the receiver adds data of a second unique code to the train detecting signal and transmits the thus processed train detecting signal. The wayside controller includes a unique code checker for checking whether or not the first unique code and the second unique code agree with the contents of a predetermined code.

8 Claims, 7 Drawing Sheets

FIG.2

| | | | |
|---|---|---|---|
| TRACK CIRCUIT 1 | TRANSMITTER/ RECEIVER DEVICE 11 | UNIQUE CODE 1A | 00010 |
| | TRANSMITTER/ RECEIVER DEVICE 12 | UNIQUE CODE 1B | 00011 |
| TRACK CIRCUIT 2 | TRANSMITTER/ RECEIVER DEVICE 21 | UNIQUE CODE 2A | 00100 |
| | TRANSMITTER/ RECEIVER DEVICE 22 | UNIQUE CODE 2B | 00101 |
| TRACK CIRCUIT 3 | TRANSMITTER/ RECEIVER DEVICE 31 | UNIQUE CODE 3A | 00110 |
| | TRANSMITTER/ RECEIVER DEVICE 32 | UNIQUE CODE 3B | 00111 |
| TRACK CIRCUIT 4 | TRANSMITTER/ RECEIVER DEVICE 41 | UNIQUE CODE 4A | 01000 |
| | TRANSMITTER/ RECEIVER DEVICE 42 | UNIQUE CODE 4B | 01001 |
| ⋮ | ⋮ | ⋮ | ⋮ |
| TRACK CIRCUIT n | TRANSMITTER/ RECEIVER DEVICE n1 | UNIQUE CODE nA | 11110 |
| | TRANSMITTER/ RECEIVER DEVICE n2 | UNIQU ECODE nB | 11111 |

TRAIN DETECTION SYSTEM AND A TRAIN DETECTION METHOD

CROSS REFERENCE TO RELATED APPLICATION

This is a continuation of U.S. application Ser. No. 09/986,089, filed Nov. 7, 2002, now U.S. Pat. No. 6,470,244, which is a continuation of U.S. application Ser. No. 09/832,043, filed Apr. 11, 2001, now U.S. Pat. No. 6,317,664, which is a continuation of U.S. application Ser. No. 09/073,851, filed May 7, 1998, now U.S. Pat. No. 6,230,085, the subject matter of which is incorporated by reference herein.

BACKGROUND OF THE INVENTION

The present invention relates to a method of detecting a train in a block section using a track circuit, and particularly to a train detecting method which is capable of maintaining safety even in the event of a failure in a signal transmission path of the track circuit.

A conventional railway system employs a method which uses a track as part of a signal transmission path to detect the existence of a train in a block section. In such a method, the track is electrically divided into plural sections, each having a predetermined length. Such a section forms a part of an electric circuit, which is commonly referred to as a track circuit. At respective ends of each track circuit, there are arranged transmitter/receiver devices, one of which transmits a signal for detecting a train continuously or at a constant time interval and the other of which receives the transmitted signal.

If a train does not exist in the section formed by a track circuit, a signal transmitted by a unit on the transmitting side is able to reach the unit on the receiving side. If, however, a train exists in the section formed by the track circuit, a signal transmitted by a unit on the transmitting side does not reach the unit on the receiving side, because the pair of rails which form the track circuit are short-circuited by the wheels of the train. Thereby, the existence of a train in the section can be detected.

In detecting the existence of a train, a high reliability is required, because a control device on the ground (a wayside controller) utilizes a train detecting signal generated as described above to locate the train and to operate traffic signals for the train. Particularly, for the purpose of securing adequate safety in the train service, it is absolutely essential to avoid possibility that, although a train actually exists within a certain section forming a track circuit and therefore the pair of rails which form the track are short-circuited, a signal indicating no train in the section of the track circuit is erroneously transmitted, possibly due to a failure in a transmitter/receiver device, for example.

Conventionally, to solve such a problem, highly reliable equipment has been used for the transmitter/receiver devices installed in every track circuit, as well as for the wayside controller. When any trouble occurs in transmitting or receiving signals, the control which is carried out is as follows: i.e., no signal is transmitted on the transmitting side, and a determination is then made as to whether no signal is received on the receiving side.

In the conventional system as mentioned above, the large number of transmitter/receiver devices must be subject to very careful maintenance. Further, an individual signal cable is used for the connection between every transmitter/receiver device and the wayside controller, in order to avoid possible misrecognition of information among the devices.

Furthermore, JP-A 6-92232 proposes that a signal, which has a different frequency for every track circuit, be used in order to avoid erroneously receiving a train detecting signal from an adjacent track circuit.

To sum up, as described above, when any trouble occurs in transmitting or receiving, the conventional system carries out control in such a manner that, if trouble occurs on the transmitting side, no signal is transmitted, and if it occurs on the receiving side, it is judged that no signal is received. To this end, highly reliable devices must be utilized for a transmitter/receiver device. As a result, the transmitter/receiver device has become complicated in its structure and therefore cannot be made small in size.

Since such a device is needed for every track circuit, the total system becomes extremely high in cost. Further, in order for a transmitter/receiver device to achieve the above mentioned control, it must be sufficiently maintained and inspected. Such maintenance and inspection work is very troublesome, since the work must be done for every one of a large number of devices arranged along a wayside.

Further, while the technology disclosed in JP-A-6-92232 might have the effect to avoid erroneously receiving a train detecting signal from an adjacent track circuit, it cannot solve the problem of being high in cost, due to its complicated system construction, which is needed for maintaining the reliability of a transmitter/receiver device, nor the problem of being very troublesome in the amount of maintenance and inspection work required to assure proper operation thereof.

SUMMARY OF THE INVENTION

An object of the present invention is to provide a train detection system of simple construction for detecting the existence of a train and which is easily operable on a fail-safe basis when trouble occurs in transmitting or receiving a signal indicating the existence of a train in a track circuit section.

Further, another object of the present invention is to provide a train detection system which can easily detect a failure in a signal transmission path with a simple structure.

The above mentioned objects can be attained by a train detection system comprising a transmitter for transmitting a train detecting signal to a track circuit, a receiver for receiving the train detecting signal from the track circuit, and a wayside controller connected to the transmitter and the receiver through a data transmission path for supplying the train detecting signal to the transmitter and receiving the train detecting signal from the receiver to detect the existence of a train, wherein the transmitter comprises a unique code memory for storing first unique code data and for adding the first unique code data to the train detecting signal received from the wayside controller, which signal is then transmitted to the track circuit, wherein the receiver comprises a unique code memory for storing second unique code data and for adding the second unique code data to the train detecting signal with the first unique code data received from the track circuit, which signal is then transmitted to the wayside controller, and wherein the wayside controller comprises unique code checking means for checking whether or not the first unique code data and the second unique code data received from the receiver agree with the contents of predetermined stored data.

With the above mentioned construction, even if any failure occurs in a transmitter or a receiver and the receiver erroneously produces a detecting signal indicating no existence of a train to a wayside controller, the controller judges the possibility of the train existence and can perform safe control, because the detecting signal does not include the required unique code data or, if included, the included unique code data is not correct.

If any failure occurs in another portion of the transmission path, the failure can be detected in a similar way. Further, if the receiver erroneously receives a signal from an adjacent track circuit, which is transmitted to the wayside controller, the controller can judge that it is an error signal.

According to the above mentioned construction, if only a wayside controller for checking the unique codes is constructed with a very high reliability, a transmitter/receiver device to be provided for every track circuit can be made with a simple structure, which can reduce the cost of the total system (only one wayside controller is required for a lot of track circuits).

Further, if the wayside controller is highly reliable, there occurs no serious problem, even if the transmitter/receiver device itself provided in every track circuit has a relatively low reliability. Therefore, it is possible to simplify the maintenance and inspection work of many transmitter/receiver devices arranged along a railway.

BRIEF DESCRIPTION OF THE DRAWINGS

FIG. 2 is a table showing an example of unique codes used in the embodiment of the present invention;

DETAILED DESCRIPTION OF THE PREFERRED EMBODIMENTS

In the following, a detailed description will be made of the present invention, referring to the accompanying drawings.

Figure 1:
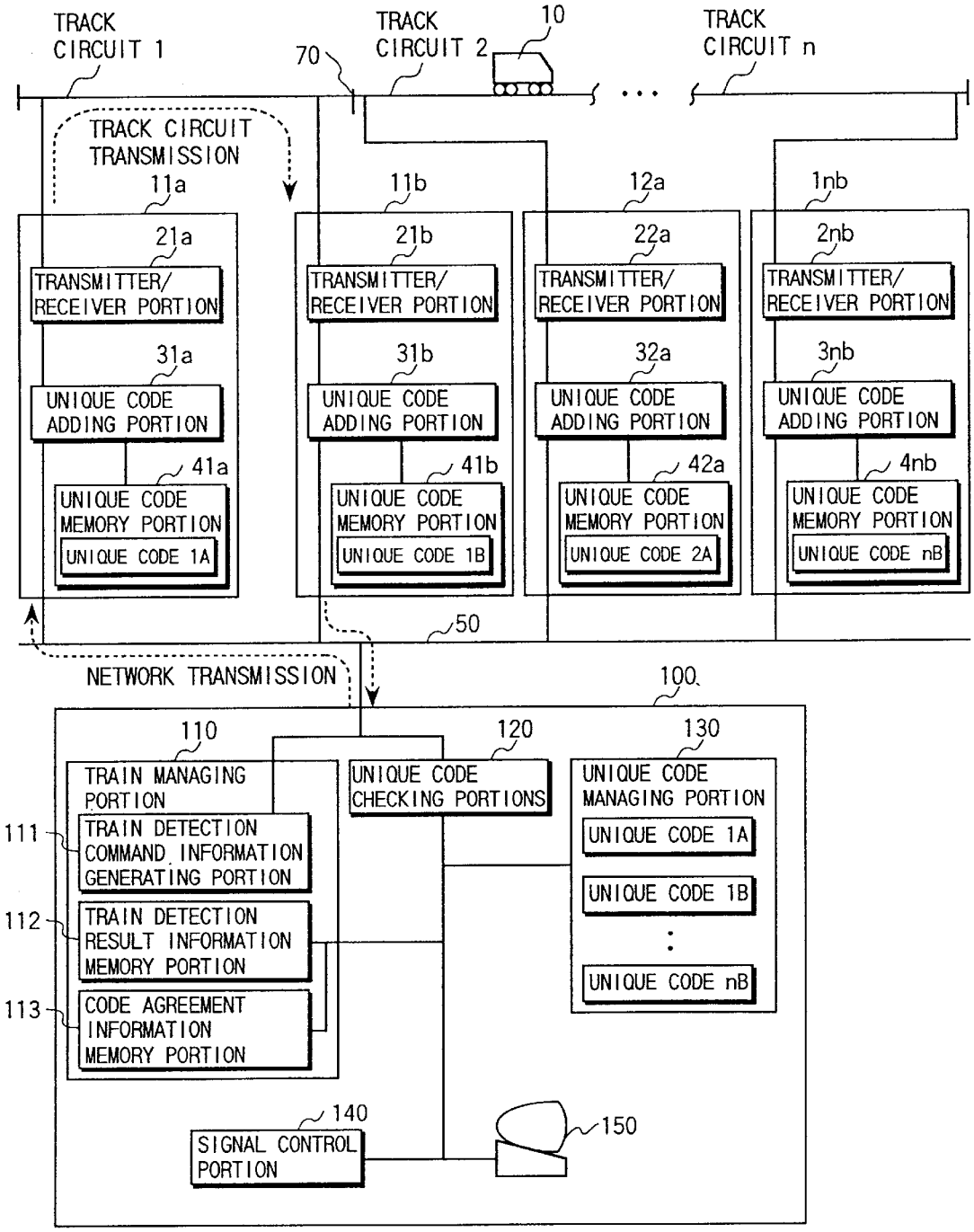
FIG. 1 is a schematic block diagram of a train detection system according to an embodiment of the present invention.

FIG. 1 shows the construction of a train detection system in accordance with an embodiment of the present invention. In order to detect the position of train 10 traveling on a track, the track is divided into n sections of track circuits (1, 2, . . . n) sectioned by insulator members 70. Both ends of every track circuit are connected to transmitter/receiver devices (11*a*, 11*b*, 12*a*, . . . , 1*nb*) for transmitting a signal to and receiving a signal from the track circuit, the signal being used for detecting the existence of a train in the track circuit. Each of the transmitter/receiver devices is also connected to a wayside controller 100 through a network 50.

In order to perform the processing for train detection, the wayside controller 100 generates train detection command information using a train detection command generating portion 111 which forms part of a train managing portion 110, which information is transmitted to each of the transmitter/receiver devices through the network 50.

Each transmitter/receiver device receives the train detection command information from the wayside controller and transmits it its own track circuit. Since each of the transmitter/receiver devices is connected to another transmitter/receiver device through a track circuit (the transmitter/receiver device 11*a* is connected to the transmitter/receiver device 11*b* through the track circuit 1, for example), the train detection command information is transmitted to the receiving transmitting/receiver device by transmission through the track circuit. Then, the receiving transmitter/receiver device transmits the information received from the track circuit as received information to the wayside controller 100 through the network 50. The wayside controller 100 detects the existence of a train by detecting the presence or absence of the information received from the transmitter/receiver device.

In the case where a train exists in the track circuit 1, for example, the rails are short-circuited by the wheel shafts of the train and, accordingly, a signal transmitted to the track circuit 1 by the transmitter/receiver device 11 a cannot be received by the transmitter/receiver device 11*b*. As a result, the wayside controller 100 judges that a train is present in the track circuit section, based on absence of the received signal.

The transmitter/receiver devices (11*a*, 11*b*, 12*a*, . . . , 1*nb*) have unique code memory portions (41*a*, 41*b*, 42*a*, . . . , 4*nb*), in which a unique code 1A, 1B, 2A, . . . , nB is retained, respectively. Further, the transmitter/receiver devices (11*a*, 11*b*, 12*a*, 1*nb*) have unique code adding portions (31*a*, 31*b*, 32*a*, . . . , 3*nb*) for adding information of a unique code to the information string of a received signal, when a signal is transmitted to the track circuit and when a signal received from the corresponding track circuit is transmitted to the network 50.

As a method of transmitting arbitrary information through a track circuit, there is a method by which an analog wave having a frequency of about 20 kHz is used as a carrier and is frequency modulated. Therefore, each of the transmitter/receiver devices can perform the process of converting digital information to an analog wave to transmit it to the track circuit, as well as the process of converting an analog wave received from the track circuit to digital information. A method using a DSP (Digital Signal Processor), for example, can be utilized for the processing mentioned above.

Further, the wayside controller 100 comprises a unique code managing portion 130 for storing data relating to the correspondence between the respective track circuits and the transmitter/receiver devices, as well as the unique codes of all of the transmitter/receiver devices.

Using a unique code attached to a signal received from the network 50, the train detection command information obtained from the train detection command information generating portion 111 and a proper unique code obtained from the unique code managing portion 130, unique code checking portion 120 checks whether or not an error exists in the unique code attached to the signal received from the network 50.

Thereby, it can be confirmed whether the train detection command information transmitted to the network correctly corresponds to the received information. Then, in case of agreement, the code agreement information is transferred from the unique code checking portion 120 to the train managing portion 110. The train detection result judged by the train managing portion based on the code agreement information is stored in train detection result information memory portion 112 as train detection result information, and the result of checking the code is stored in code agreement information memory 113 as code agreement information.

At the same time, these results are displayed on a display 150 and are used 10 for train control by signal control portion 140.

With such a construction, it is necessary to construct a wayside controller using devices with a sufficient safety factor. To attain this, hardware may be constructed by a multisystem computer, for example. Further, a transmitter/receiver device can employ a simpler construction, compared with that of the wayside controller.

For example, it is possible to employ a transmitter/receiver device of simple construction having a ROM including a unique code memory portion therein, as well as a microprocessor unit performing the processing for a unique code adding portion and the processing for the transmitting and receiving portion, as described above, the components of which are mounted on a board and accommodated in a cabinet. Therefore, the cost for the total system can be reduced.

Furthermore, even if a failure occurs in a transmitter/receiver device itself and a signal indicating no existence of a train is erroneously supplied to the wayside controller, the signal has no unique code added thereto, or, if a code is added thereto it will be an incorrect code. Therefore, a wayside controller can judge that there is the possibility of existence of a train in the track circuit section and execute safe control even in the event of a device failure. Accordingly, the maintenance and inspection work of the large number of transmitter/receiver devices installed along a railway may be performed only when disagreement between unique codes occurs in the wayside controller, which can simplify the maintenance and inspection work.

FIG. 2 shows examples of a unique code. The figure is a table, which correspondingly indicates the transmitter/receiver devices connected to corresponding track circuits, the unique codes retained in the transmitter/receiver devices and the specific bit data of the unique codes. In this example, the unique codes are expressed in the form of 5 bit data of continuing values, but the values also can be arbitrarily selected, so long as the codes are different on the transmitting side and on the receiving side. However, it is preferable when different unique codes are allotted to different track circuits as in the present embodiment, because an error can be more certainly detected, even if a signal of an adjacent track circuit is erroneously received. Each of the transmitter/receiver devices retains only one unique code corresponding thereto, and the wayside controller stores all the unique codes in its unique code managing portion 130. For example, the wayside controller stores the table as shown in FIG. 2 in the unique code managing portion 130.

In the following, an example of an information processing procedure, among the various devices employing the train detection processing, will be described using these unique codes, in the case where it is to be determined whether or not a train exists in the section including track circuit 1.

At the outset, the wayside controller 100 transmits train detection command information to the transmitter/receiver device 11*a*. The signal structure of the train detection command information is assumed to have the following content:

Train existence detection command information={011101} (1)

Therefore, the following information is transmitted.

Transmitted information={Train detection command information}={011101} (2)

The transmitter/receiver device 11*a* adds its unique code to the train detection command information being transmitted.

Figure 3:
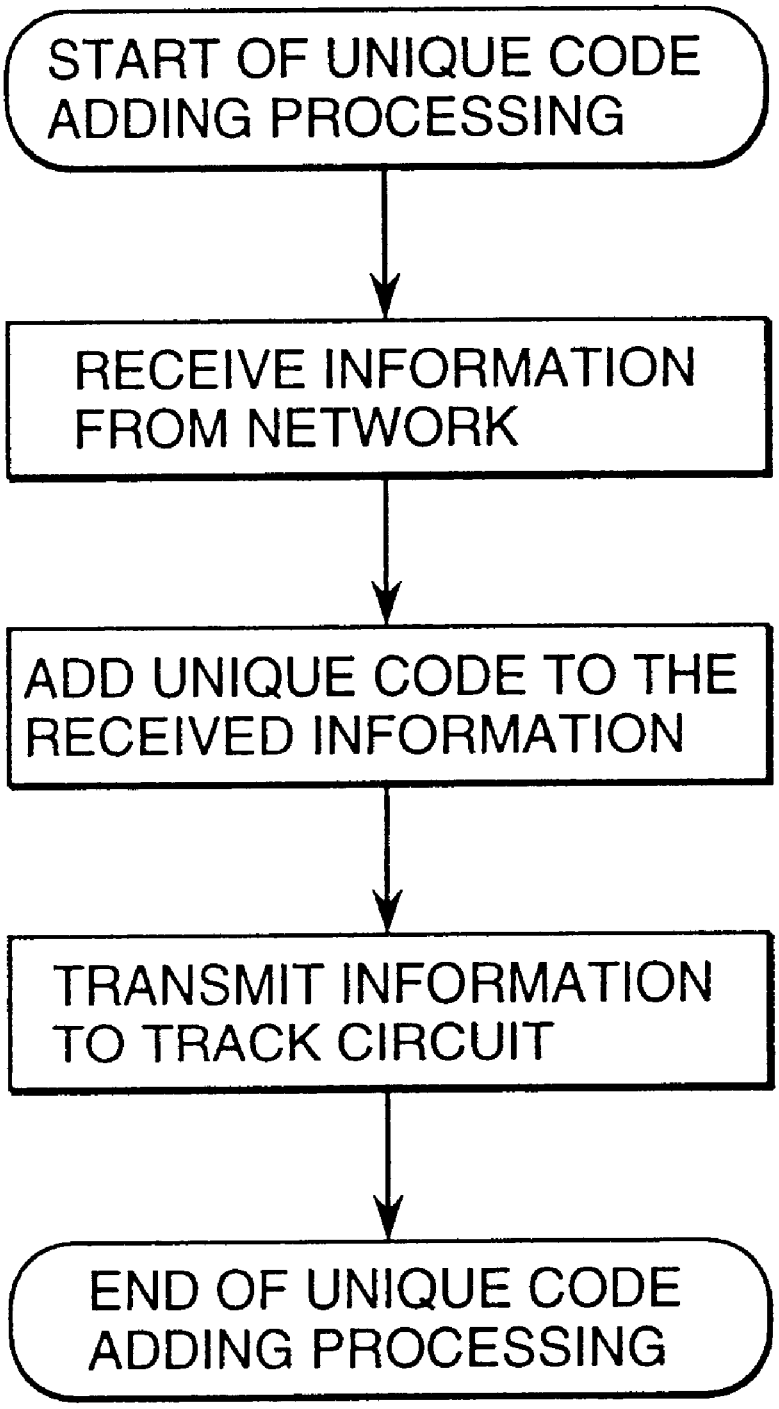
FIG. 3 is a flow chart showing a procedure for the adding of a unique code to network information in the embodiment of the present invention.

FIG. 3 shows an example of the procedure for adding the unique code.

The transmitter/receiver device 11*a* receives the train detection command information from the network 50 and transmits a signal to the track circuit 1 using the transmitter/receiver portion 21*a*. At that time, the unique code adding processing is performed by the unique code adding portion 31*a* in the transmitter/receiver device 11*a*.

The unique code adding portion 31*a* adds the code information {00010} of the unique code 1A held in the unique code memory portion 41*a* to the train detection command information and sends the information with the added code to the transmitter/receiver portion 21*a* for transmission. The adding of the unique code is assumed to be a process for adding the information of the unique code to the information to be transmitted.

In this embodiment, although the unique code is added to the information as a series of bits which follows the information, the unique code may be placed before information.

Thus, the following information is transmitted to the track circuit.

Transmitted information={Train detection command}+{Identification code 1A}={011101}{00010} (3)

The transmitter/receiver device 11*b* receives a signal from the track circuit 1 and decodes it by using the transmitter/receiver portion 21*b*. The received information obtained as a result of the decoding is transmitted to the wayside controller 100 through the network 50. At this time, the received information is transmitted to the wayside controller 100 after the code information {00011} of the unique code 1B held in the unique code memory portion 41*b* is added thereto by the unique code adding portion 31*b*. The procedure of adding the unique code 1B is the same as shown in FIG. 3. To this end, the following information is transmitted to the wayside controller 100 via network 50.

Transmitted information={Train detection command}+{Identification code 1A}+{Identification code 1B}={011101}{00010}{00011} (4)

As a result, the wayside controller 100 receives the information {011101 }{00010}{00011} as information corresponding with the transmitted information {011101}. The received information contains the unique codes of the transmitter/receiver device 11*a* and the transmitter/receiver device 11*b*, which are devices on the information transmission path.

On the other hand, the wayside controller 100 recognizes, from data stored in the unique code managing portion 130, that the transmitter/receiver devices in the objective track circuit 1 are the transmitter/receiver device 11*a* and the transmitter/receiver device 11*b* and identifies the unique codes thereof.

The unique code checking portion 120 compares the received information with the information stored in the unique code managing portion 130.

Figure 4:
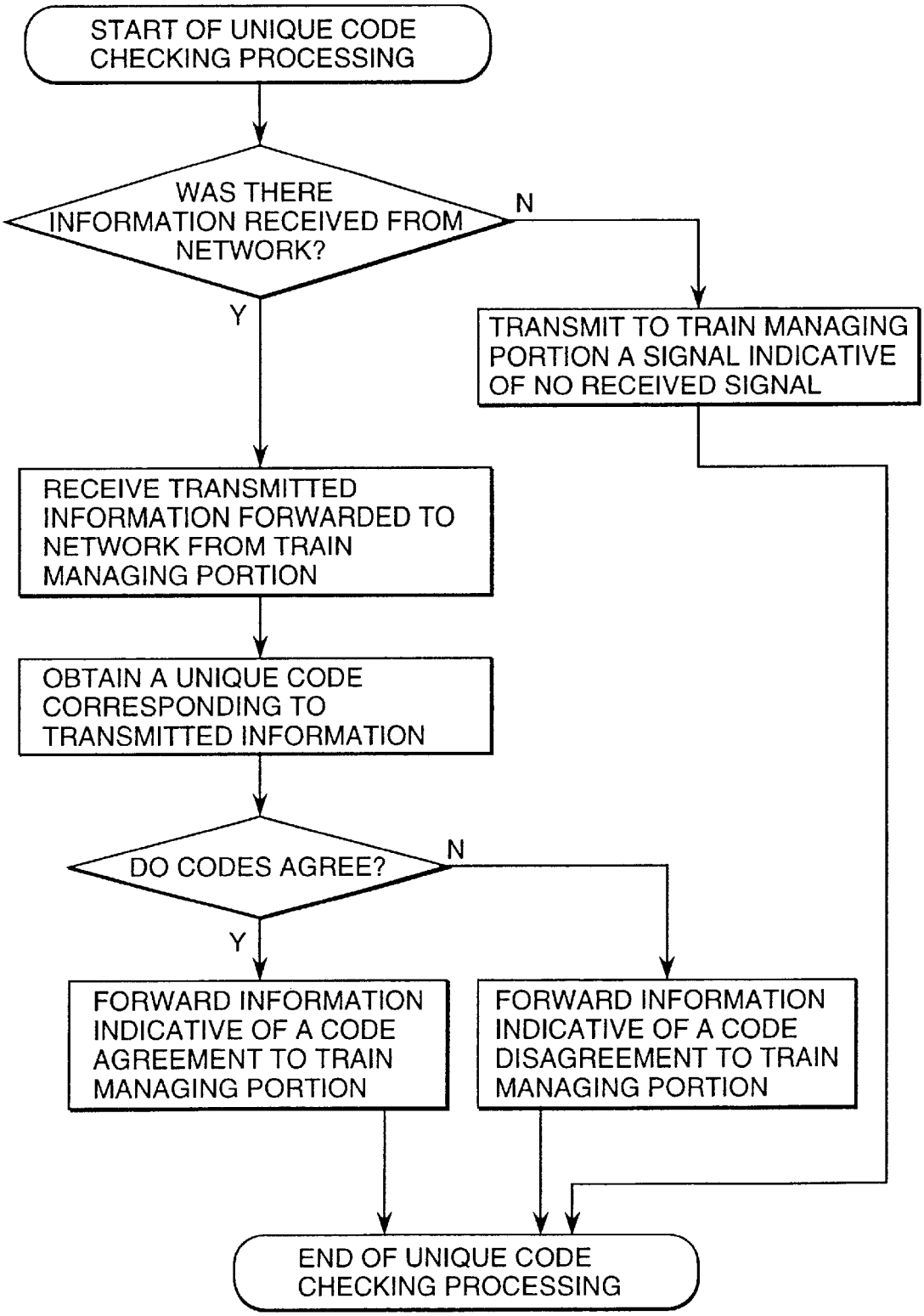
FIG. 4 is a flow chart showing a procedure for checking of a unique code in the embodiment of the present invention.

An example of the processing procedure thereof is shown in FIG. 4.

First of all, the unique code checking portion 120 executes the processing of confirming whether or not information has been received from the network 50. If no information is received, the train detection result information to that effect is transmitted to the train managing portion 110.

If information is received from the network 50, the unique code checking portion 120 receives the train detection command signal which has been transmitted from the train managing portion 110 to the track circuit through the network 50. Also, the unique code checking portion 120 receives a unique code of a transmitter/receiver device of a corresponding track circuit from the unique code managing portion 130. In this embodiment, the unique code 1A and the unique code 1B are received. The unique code checking portion 120 generates the information for checking (such information would be received, if there is no failure in the transmission path).

Then, the unique code checking portion 120 checks whether or not the string of code agrees between the information actually received from the network 50 and the information for checking.

If the received information is normally transmitted, the following condition is satisfied.

Transmitted information={011101}{00010}{00011} (5)

On the other hand, the information for checking is as follows.

Information for checking={Train existence detection command}

{Identification code 1A}{Identification code 1B}={011101}{00010}{00011} (6)

Therefore, by the checking process carried out in the unique code checking portion 120, it is judged whether the received information and the information for checking agree with each other. On the basis of this comparison, it can be confirmed whether the transmitter/receiver device in the track circuit, corresponding to a section in which a train is detected to exist, is a device in the track circuit 1, which is identified by the received train existence detection command.

In the foregoing process, the checking is performed on both the train detection command signal and the identification code information. However, a failure of the transmitter/receiver device can be detected by checking the identification code information only.

On the other hand, when a train exists in the section corresponding to the track circuit 1, the signal transmitted by the transmitter/receiver device 11 to the track circuit 1 is short-circuited by the wheels of the train, with the result that the signal is not received by the transmitter/receiver device, and, hence, the signal does not return to the unique code checking portion 120.

As described above, in such case, the unique code checking portion 120 transmits information indicating no received signal to the train managing portion 110. Upon receiving the information, the train managing portion 110 judges that a train exists in the track circuit 1, and the result of the judgement is stored in the train detection result information memory portion 112 as train detection result information.

Next, description will be made of the case where a failure occurs in one or both the transmitter/receiver devices 1*a*, 1*b*, the track circuit 1 and/or the network 50. As far as the detection of a train is concerned, the wayside controller 100 is required to judge that a train exists and to perform the processing required to maintain the safety of the train, even if the train does not actually exist.

Firstly, consideration will be given to the case where a failure occurs in either one or both of the transmitter/receiver devices 1*a* and 1*b*.

In the case where the unique code information has an error, the received information will contain a code different from the original one. For example, when {00010} becomes {01010} because of a bit error in the transmitter/receiver device 1*a*, the unique code contained in the signal received by the wayside controller 100 does not agree with the information for checking.

Received information={011101}{01010}{00011}

Information for checking={011101}{00010}{00011} (7)

As a result, the unique code checking portion 120 judges that the unique codes disagree. The checking portion 120 transmits the code agreement information, including information as to what unique code includes an error, to the train managing portion 110. With this, it is possible to detect the fact that a failure has occurred in the transmission path.

Further, in the case where a failure occurs in the unique code adding portion 31*b* itself, the unique code will not be contained in the transmitted information. As a result, the unique code contained in the signal received by the wayside controller 100 does not agree with the information for checking.

Received information={0111101}{ }{00011}

Information for checking={011101}{00010}{00011} (8)

As a result, similar to the above, it is possible to detect the fact that a failure has occurred in the transmission path.

In the case where no signal is transmitted to the track circuit due to a failure, no signal flows through the track circuit 1. Since no signal is returned to the wayside controller 100, it is judged that no signal exists and, hence, that a train is present in the section corresponding to the track circuit. Accordingly, the safety of the train can be ensured.

Next, consideration will be given to the case where a failure occurs in the track circuit 1 and/or the network 50. When information cannot be transmitted due to such a failure in the track circuit or the network circuit, the situation becomes similar to the situation wherein no signal is transmitted due to failure of a transmitter/receiver device. Therefore, the wayside controller judges that no signal exists and, hence, that a train is present in the section corresponding to the track circuit. Accordingly, the safety of the train can be ensured in this case, too.

Further, when the transmitted information is changed by occurrence of a bit error during transmission, the situation becomes similar to the situation that a failure occurs in the unique code of a transmitter/receiver device or in the unique code adding portion thereof. Accordingly, the occurrence of a failure in the transmission path can be detected by the checking process performed by the wayside controller.

When a failure is detected in the transmission path and the train detection processing is continued nevertheless, there is the possibility that the safety of the train can not be ensured. When, therefore, the occurrence of a failure is detected, the following processing is carried out, whereby the safety of the train can be secured.

For example, first of all, the occurrence of a failure is displayed in the displaying portion 150 to inform an operation controller thereof. Further, by informing the signal control portion 140 of the occurrence of a failure, various traffic signals are controlled under the assumption that a train exists in a corresponding track circuit section. Furthermore, simply, a traffic signal for stopping the train can be given.

As described above, the train detection system according to the present embodiment can ensure the safety of the train, even in the case where a failure occurs in devices on a signal transmission path.

In the following, another embodiment of the present invention will be described.

This embodiment relates to a case where, as another example of the processing method carried out in the unique code adding portion, a mask processing is carried out on an information series of a received signal, based on an information series of a unique code.

In this embodiment, it is assumed that EOR (Exclusive OR) processing is utilized for the mask processing. It is clear that even if a logical operation processing other than Exclusive OR processing is utilized, it is possible to confirm whether or not correct information is returned to a wayside controller, so long as the same effect as the mask processing in the unique code checking portion can be attained.

Figure 5:
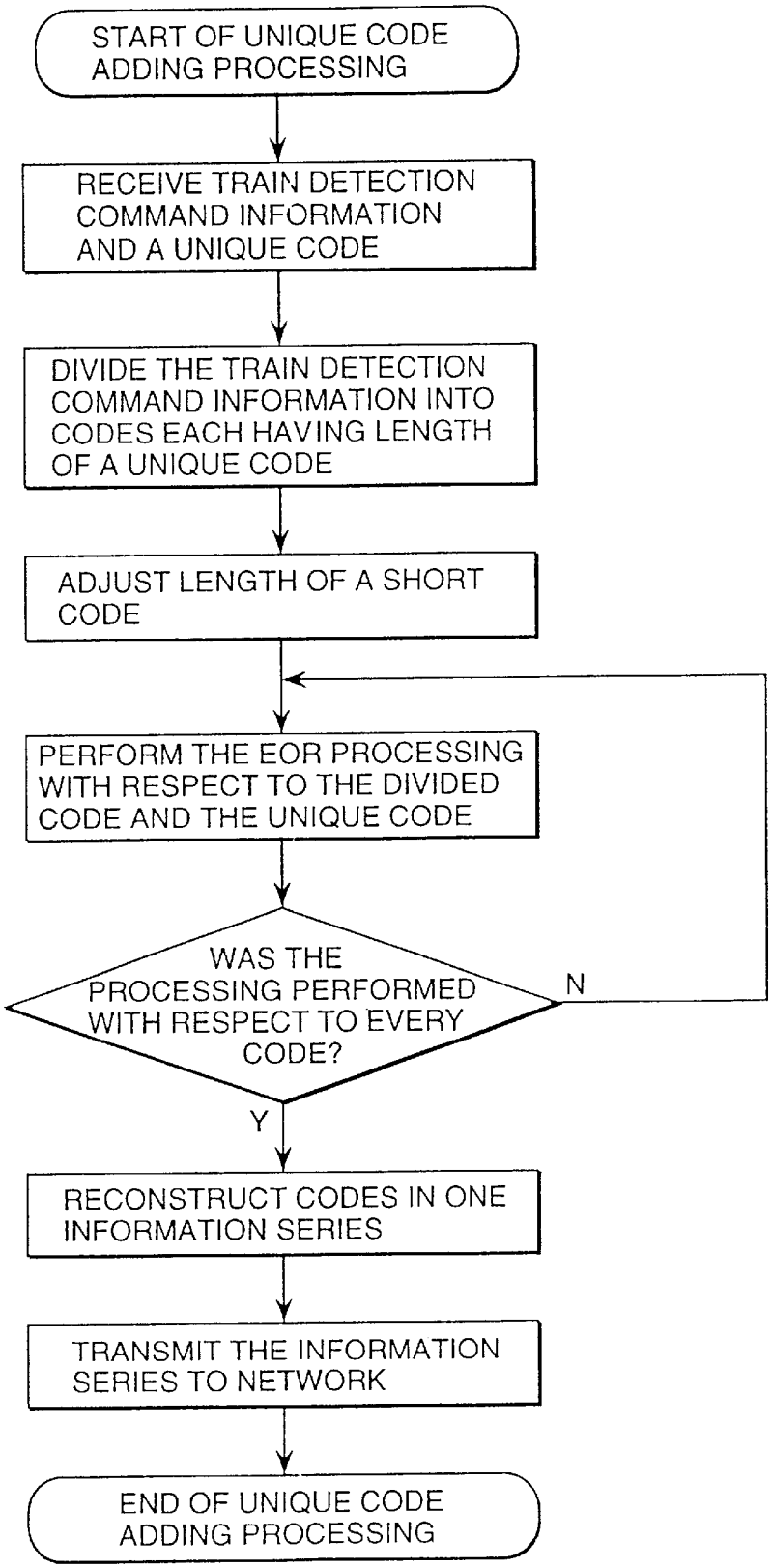
FIG. 5 is a flow chart showing a procedure for the adding of a unique code to train detection command information in another embodiment of the present invention.
Figure 6:
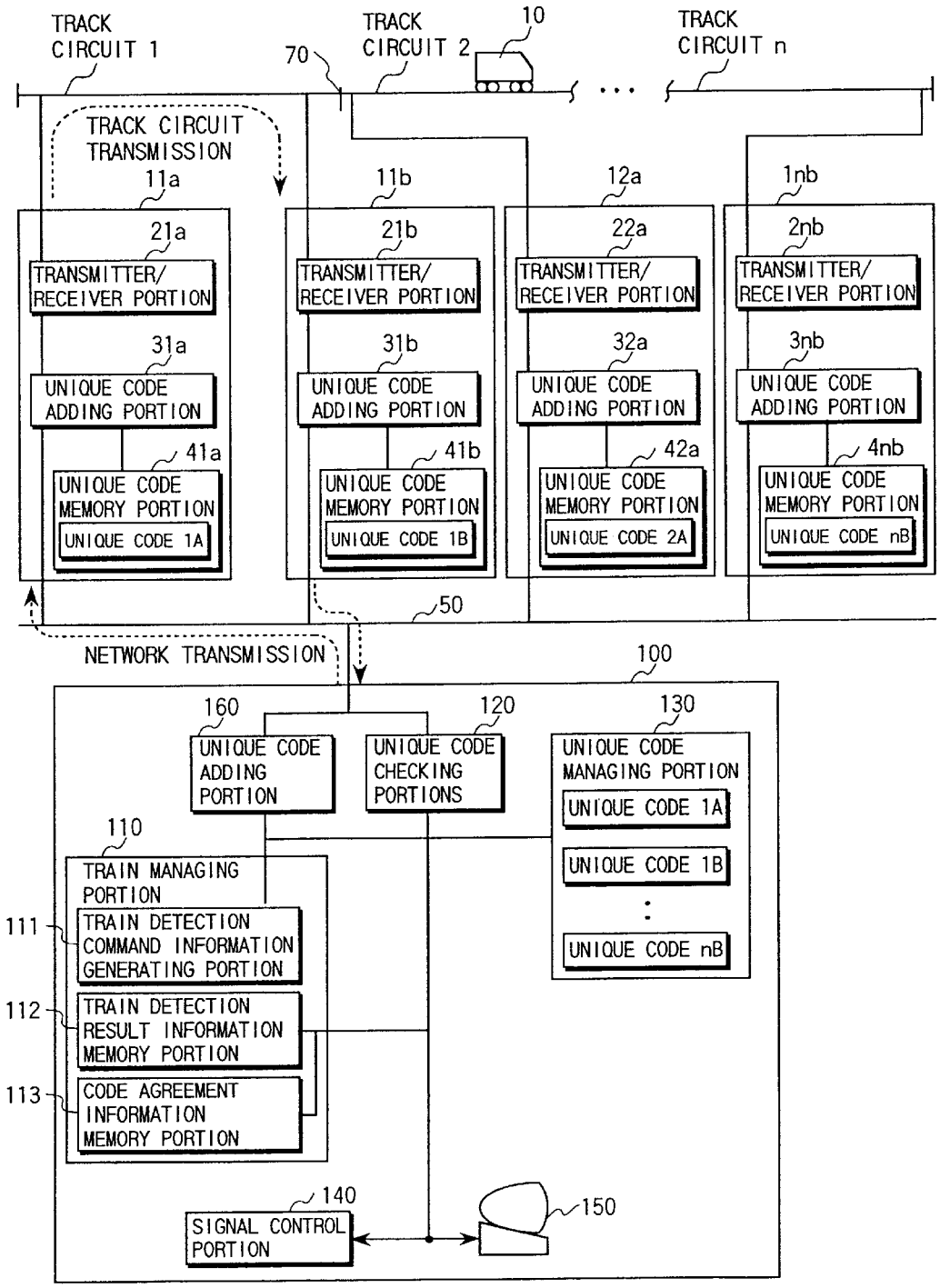
FIG. 6 is a schematic block diagram of a train detection system according to another embodiment of the present invention.

FIG. 6 schematically shows the construction of the train detection system according to the present embodiment, and FIG. 5 shows the flow of the unique information adding processing according to the present embodiment. In FIG. 6, the same reference character as in FIG. 1 indicates the same element as in FIG. 1.

Unique code adding portion 160 is provided in addition to unique code adding portions 31*a*, 31*b*, 32*a*, . . . , 3*nb* to send out the result of the mask processing, which is carried out with respect to received information by using EOR processing between the received information and the unique code.

Further, in this embodiment, the above mentioned mask processing is performed in the unique code checking portion 120, as will be described later. If the is received information is large, compared with the unique code, the mask processing is performed with respect to each information series divided into the size of the unique code. Further, if the size of the received information or a part of the aforesaid divided information is smaller than that of the unique code, provisional information is temporarily added to the information series at the rear thereof to adjust the length and is cut off when the information is reconstructed.

The EOR processing has such a characteristic that an original code can be obtained, only when processing using the same code is repeated twice with respect to an objective code. The following is assumed in the present embodiment: i.e., the mask processing is performed in a unique code adding portion in a transmitter/receiver device on the transmitting side.

In the present embodiment, however, the processing corresponding to such mask processing is performed in the unique code adding portion 160 of the wayside controller 100, in advance, and thereafter the thus processed signal is transmitted. Further, the unique code checking portion 120 of the wayside controller 100 executes the processing corresponding to the mask processing carried out in the unique code adding portion in a transmitter/receiver device on the receiving side. Referring to FIG. 5, the unique code adding processing in this embodiment will be described below. FIG. 5 is a flow chart showing the unique code adding processing performed by the unique code adding portion 160. A description will be made of the case where processing for detecting a train in the section of the track circuit 1 is performed in the system as shown in FIG. 6.

In the wayside controller 100, first of all, the train managing portion 110 generates train detection command information using the train detection command information generating portion 111. The content of the train detection command information is assumed to be as follows.

$$\text{Train detection command information}=\{011101\} \tag{9}$$

The train detection command information is transferred to the unique code adding portion 160, which portion performs the mask processing with respect to the train detection command information. This mask processing uses a unique code (unique code 1A) retained in the transmitter/receiver device 11*a*, which receives the train detection command information.

The unique code adding portion 160 firstly receives the unique code (unique code 1A) of the transmitter/receiver device 11*a* as a destination device from the unique code managing portion 130.

$$\text{Identification code 1A}=\{00010\} \tag{10}$$

It can be understood that the information series of the train detection command information may be longer than the information series of the unique code 1A. In such case, the unique code adding portion 160 divides the objective train detection command information into a plurality of information series with a unit of length of the unique code 1A and performs EOR processing with respect to each of the plurality of information series. The thus processed information series are constructed in one information series, again. As a result, the wayside controller 100 transmits the following information to the network 50, which has been subject to the mask processing in the unique code adding portion 160.

$$\begin{aligned}&\text{Transmitted information}=\{011101\}EOR\{00010\}=\\&\{01110\}EOR\{00010\}+\{1\}EOR\{00010\}=\{01100\}+\{1\}=\\&\{011001\}\end{aligned} \tag{11}$$

Next, the transmitter/receiver device 11*a* receives the transmitted information from the network 50 and performs the mask processing by the unique code adding portion 31*a*. At this time, the unique code 1A retained in the unique code memory portion 41*a* of the transmitter/receiver device 11*a* is utilized. The procedure of the mask processing is the same as that of the processing shown in FIG. 5. As a result, the information transmitted to the track circuit 1 by the transmitter/receiver device 11*a* is as follows.

$$\begin{aligned}&\text{Transmitted information}=\\&\{011001\}EOR\{00010\}\{01100\}EOR\{00010\}+\\&\{0\}EOR\{00010\}\{01110\}+\{1\}\{011101\}\end{aligned} \tag{12}$$

The processing performed by the transmitter/receiver device 11*b*, which receives the transmitted information from the track circuit 1, is the same as the mask processing of the transmitter/receiver device 11*a*. However, the transmitter/receiver device 11*b* performs the processing using the information {00011} of the unique code 1B retained in the unique code memory portion 41*b* and sends the result thereof to the network 50.

$$\begin{aligned}&\text{Transmitted information}=\\&\{011101\}EOR\{00011\}\{01110\}EOR\{000111\}+\\&\{1\}EOR\{00011\}=\{01101\}+\{1\}=\{010111\}\end{aligned} \tag{13}$$

Figure 7:
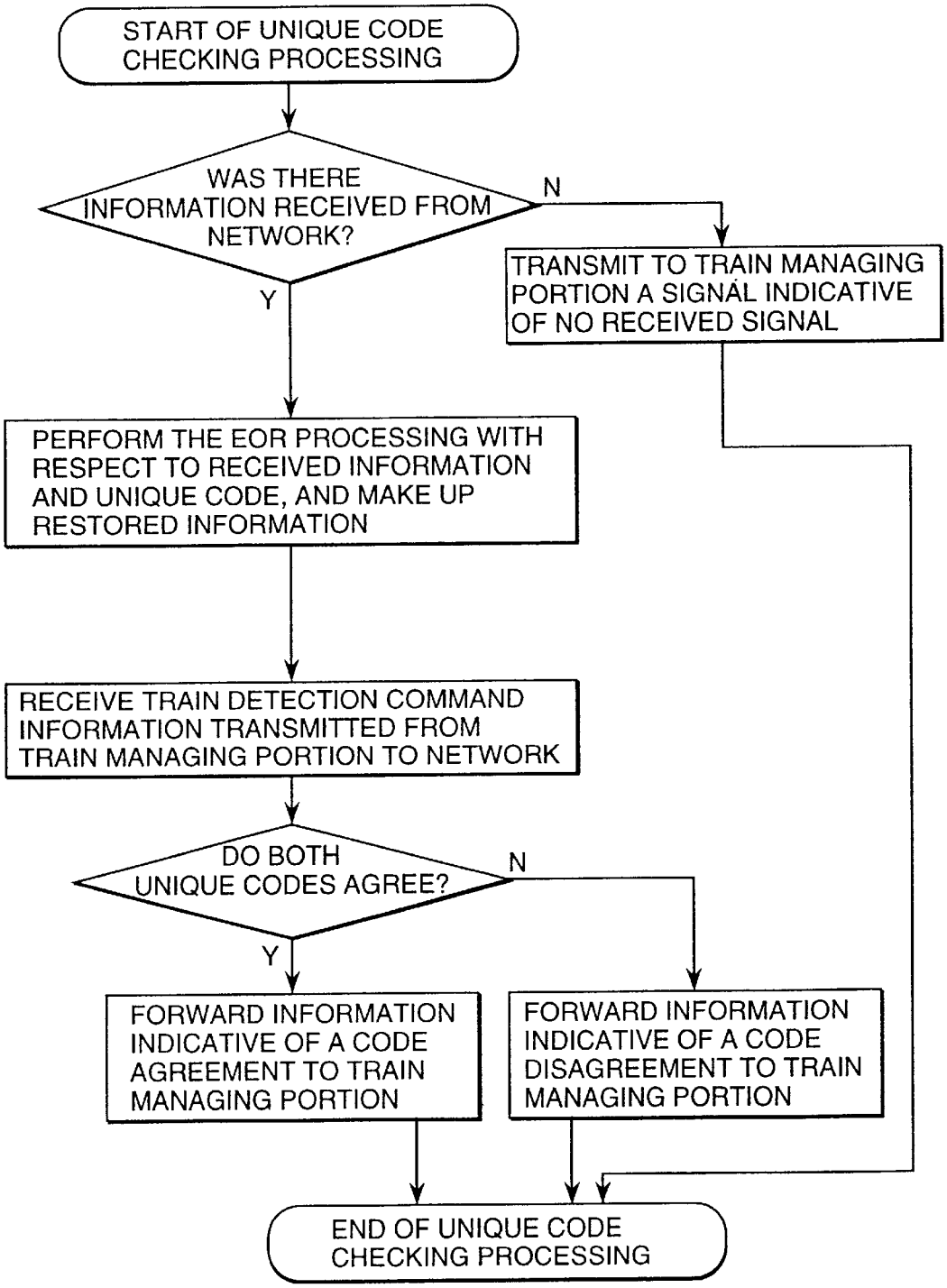
FIG. 7 is a flow chart showing a procedure for unique code checking according to the present invention.

As a result, the wayside controller 100 receives the information {011011}, instead of the train detection command information {011101}. The content of the received information is confirmed in the unique code checking portion 120. This procedure is shown in FIG. 7.

Since the transmitted information received by the wayside controller 100 is subject to the mask processing by the unique code is of the transmitter/receiver device 11*b*, it is subject to the mask processing, again, and needs to be restored to the original code, before confirmation in the unique code checking portion 120. The procedure of this mask processing is the same as that of the processing shown in FIG. 5.

That is, in the unique code checking portion 120, it is confirmed at first whether or not the transmitted information is received from the network 50. If received, restored information is obtained by mask processing with respect to the transmitted information received, which processing uses the unique code 1B {00011} corresponding to the transmitter/receiver device 11*b*. The unique code 1B is obtained from the unique code managing portion 130.

Transmitted information received={011011}

Restored information={011011}*EOR*{00011}={01101}*EOR*{00011}+{1}*EOR*{00011}={01110}+{1}={011101} (14)

Next, the unique code checking portion 120 receives the original train detection command information from the train managing portion 110.

Train existence detection command information={011101} (15)

Then, the unique code checking portion 120 performs processing to check whether or not the recovered information agrees with the train detection command information obtained from the train managing portion 110. If no failure exists in the transmission path, the recovered information agrees with the train detection command information.

Therefore, it can be confirmed that the train detection command information is the information returned through the transmitter/receiver devices 11*a* and 11*b*. The result of code agreement is sent from the unique code checking portion 120 to the train managing portion 110, which recognizes that no train exists in the section corresponding to the track circuit 1 from the fact that the codes agree with each other.

On the other hand, when a train exists within the section of the track circuit 1, any information to be transmitted to the wayside controller 100 does not exist, since the transmitter/receiver device 11*b* receives no signal. As a result, the train managing portion 110 judges that a train exists within the section of the track circuit 1. The procedure to obtain this judgement is as described previously. The result of the judgement is stored in the train detection result information memory portion 112 as train detection result information.

As far as troubles in the transmitter/receiver devices 11*a* and 11*b* are concerned, in the case where they transmit or receive no signal, it is possible to ensure the safety of the train by judging that a train exists, since no signal to the wayside controller 100 exists, as described previously. Further, as far as troubles in the track circuit 1 and the network 50 are concerned, in a case where the track circuit 1 or the network 50 is disconnected, the same determination as described above can be applied.

On the other hand, in a case where a failure occurs in the unique code adding portion 31*a* or 31*b* of the transmitter/receiver device 11*a* or 11*b*, or in a case where an error occurs in the unique code retained therein, the wayside controller 100 performs mask processing with respect to the transmitted information, which is different from information to be received in a normal condition, and generates restored information.

Therefore, in a case where the unique code 1B {00011} held by the transmitter/receiver device 11*b* becomes a different information series representing a unique code 1B' {01011} due to an error, the following information will be transmitted to the wayside controller 100.

Transmitted information={Information received from the track circuit 1}

*EOR*{*Identification code 1B'*}={011101}*EOR*{01011}={01110}*EOR*{01011}+{1}*EOR*{01011}={00101}+{1}={001011} (16)

Accordingly, the restored information obtained by the unique code checking portion 120 in the wayside controller 100 becomes as follows.

Restored information={Received information}*EOR*{Identification code 1B}={001011}*EOR*{00011}={00101}*EOR*{00011}+{1}*EOR*{00011}={00110}+{1}={001101} (17)

This result does not agree with the train detection command information {011101} obtained from the train managing portion 110. Therefore, the unique code checking portion 120 sends an indication of disagreement between codes to the train managing portion 110 as code agreement/disagreement information, and the train managing portion 110 stores the transmitted information in the code agreement information memory portion 113.

As described above, the wayside controller 100 can detect that a unique code adding process in a transmitter/receiver device on a transmission path is not being carried out correctly. When disagreement between the codes is detected, the train managing portion 110, as described before, performs the processing necessary for safe train control against the signal control portion 140 and the display portion 150 in accordance with the result of the train existence judgement, as well as the failure detection result in devices within the transmission path.

According to the embodiment described above, even if a failure occurs in a transmitter/receiver device, which erroneously outputs a detection signal indicating the presence of no train in the section to the wayside controller 100, the output signal is not accompanied by the unique code signal (or is not subject to mask processing). Even if accompanied by a unique code, it is not a correct unique code (or is data obtained by an erroneous mask processing). Therefore, the wayside controller 100 judges that there is the possibility of the existence of a train within the track circuit section, whereby safe control of the train can be performed.

Further, even if a failure occurs in the information transmitted to the network 50 or the track circuit, the occurrence of the failure can be detected in the same manner as described above. Furthermore, since an individual code is allotted for every track circuit, the transmission of erroneous data can be detected, even if a transmitter/receiver device erroneously receives a signal from an adjacent track circuit and transmits it to a wayside controller.

According to the construction of the above mentioned embodiment, if the wayside controller 100, which performs checking of unique codes, is constructed as a highly reliable system (as a multi-system computer, for example), the construction of a transmitter/receiver device provided in every track circuit may be simplified, and accordingly the cost of the total system can be reduced. Further, there is no problem in the safe traffic control of trains, even if the reliability of the transmitter/receiver device itself provided in every track circuit is relatively low, if only the wayside controller has a reliability which is sufficiently high.

Therefore, it is possible to simplify the maintenance and inspection work of a lot of transmitter/receiver devices arranged along a railway.

As described above, according to the present invention, it is possible to realize a train detection system, which is capable of certainly detecting a failure in track circuits with a system of simple construction.

What is claimed is:

1. A train detection system, comprising:

a transmitter, to be connected to a track circuit, which transmits to the track circuit a train detecting signal for confirming the existence of a train in the track circuit;

a receiver, to be connected to the track circuit, which receives the train detecting signal from the transmitter through the track circuit; and a wayside controller, connected to the transmitter and the receiver, which transmits the train detecting signal to the transmitter and receives the train detecting signal from the receiver;

the transmitter adds a first unique code to the train detecting signal received from the wayside controller and transmits the thus processed train detecting signal to the track circuit;

the receiver adds a second unique code to the train detecting signal received from the track circuit and transmits the thus processed train detecting signal to the wayside controller; and the wayside controller comprises unique code checking means for checking whether or not the first unique code and the second unique code, which are received from the receiver, agree with the contents of a predetermined code.

2. A train detection system, comprising:

a transmitter, to be connected to a track circuit, for transmitting a train detecting signal to the track circuit;

a receiver, to be connected to the track circuit, for receiving the train detecting signal from the track circuit; and a wayside controller, connected to the transmitter and the receiver, for transmitting the train detecting signal to the transmitter and for receiving the train detecting signal from the receiver;

the transmitter performs operational processing with respect to information including the train detecting signal received from the wayside controller on the basis of a first unique code and transmits the thus processed information to the track circuit;

the receiver performs operational processing with respect to the information received from the track circuit on the basis of a second unique code and transmits the thus processed information to the wayside controller; and the wayside controller comprises unique code checking means for checking whether or not the information received from the receiver agrees with the contents of predetermined information.

3. A train detection system, comprising:

a transmitter, to be connected to a track circuit, for transmitting a train detecting signal to the track circuit;

a receiver, to be connected to the track circuit, for receiving the train detecting signal from the track circuit; and a wayside controller, connected to the transmitter and the receiver, for transmitting the train detecting signal to the transmitter and receiving the train detecting signal from the receiver;

the transmitter adds a unique code to the train detecting signal received from the wayside controller and transmits the train detecting signal to the track circuit;

the receiver transmits the train detecting signal to the wayside controller; and the wayside controller comprises unique code checking means for checking whether or not the unique code received from the receiver agrees with the contents of a predetermined code.

4. A train detection system, comprising:

a transmitter, to be connected to a track circuit, for transmitting a train detecting signal to the track circuit;

a receiver, to be connected to the track circuit, for receiving the train detecting signal from the track circuit; and a wayside controller, connected to the transmitter and the receiver, for transmitting the train detecting signal to the transmitter and receiving the train detecting signal from the receiver;

the transmitter transmits the train detecting signal to the track circuit;

the receiver adds a unique code to the train detecting signal received from the track circuit and transmits the train detecting signal to the wayside controller; and the wayside controller comprises unique code checking means for checking whether or not the unique code received from the receiver agrees with the contents of a predetermined code.

5. A train detection system, comprising:

a transmitter, to be connected to a track circuit, for transmitting a train detecting signal;

a receiver, to be connected to the track circuit, for receiving the train detecting signal transmitted by the transmitter through the track circuit; and a wayside controller, connected to the transmitter and the receiver, for transmitting the train detecting signal to the transmitter and for receiving the train detecting signal from the receiver;

the transmitter adds a first unique code to the train detecting signal received from the wayside controller to transmit the thus processed signal to the track circuit;

the receiver adds a second unique code to the train detecting signal including the first unique code, which is received from the track circuit, to transmit the thus processed signal to the wayside controller; and the wayside controller checks whether or not the first unique code and the second unique code, which are received from the receiver, agree with the contents of a predetermined code.

6. A train detection system, comprising:

a transmitter, to be connected to a track circuit, which transmits to the track circuit a train detecting signal;

a receiver, to be connected to the track circuit, which receives the train detecting signal from the transmitter; and a wayside controller, connected to the transmitter and the receiver, which transmits the train detecting signal to the transmitter and receives the train detecting signal from the receiver;

the transmitter adds a first unique code to the train detecting signal received from the wayside controller and transmits the thus processed train detecting signal to the track circuit;

the receiver adds a second unique code to the train detecting signal received from the track circuit, which includes the first unique code, and transmits the thus processed train detecting signal to the wayside controller; and the wayside controller comprises unique code checking means for checking whether or not the first unique code, the second unique code and the train detecting signal, which are received from the receiver, agree with the contents of a predetermined code.

7. A train detection system, comprising:

a transmitter, to be connected to a track circuit, for transmitting a train detecting signal to the track circuit;

a receiver, to be connected to the track circuit, for receiving the train detecting signal from the track circuit; and a wayside controller, connected to the transmitter and the receiver, for transmitting the train detecting signal to the transmitter and receiving the train detecting signal from the receiver;

the transmitter adds a unique code to the train detecting signal received from the wayside controller and transmits the train detecting signal to the track circuit;

the receiver transmits the train detecting signal to the wayside controller; and the wayside controller comprises unique code checking means for checking whether or not the unique code and the train detecting signal received from the receiver agrees with the contents of a predetermined code.

8. A train detection system, comprising:

a transmitter, to be connected to a track circuit, for transmitting a train detecting signal to the track circuit;

a receiver, to be connected to the track circuit, for receiving the train detecting signal from the track circuit; and a wayside controller, connected to the transmitter and the receiver, for transmitting the train detecting signal to the transmitter and receiving the train detecting signal from the receiver;

the transmitter transmits the train detecting signal to the track circuit;

the receiver adds a unique code to the train detecting signal received from the track circuit and transmits the train detecting signal to the wayside controller; and the wayside controller comprises unique code checking means for checking whether or not the unique code and the train detecting signal received from the receiver agrees with the contents of predetermined code.

* * * * *